US008009039B2

(12) United States Patent
Fallin et al.

(10) Patent No.: US 8,009,039 B2
(45) Date of Patent: Aug. 30, 2011

(54) EAS POWER MANAGEMENT SYSTEM

(75) Inventors: David B. Fallin, Coral Springs, FL (US); John J. Clark, Boynton Beach, FL (US); Scott Alan Tribbey, Coconut Creek, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 360 days.

(21) Appl. No.: 12/233,062

(22) Filed: Sep. 18, 2008

(65) Prior Publication Data

US 2010/0070785 A1 Mar. 18, 2010

(51) Int. Cl.
*G08B 1/08* (2006.01)

(52) U.S. Cl. ..... 340/539.3; 340/572.1; 340/825.36

(58) Field of Classification Search ..... 340/539.3, 340/572.1–572.9, 825.54, 825.36, 686.6, 340/539.1
See application file for complete search history.

(56) References Cited

U.S. PATENT DOCUMENTS 4,847,781 A * 7/1989 Brown et al. ..... 700/296
6,084,512 A * 7/2000 Elberty et al. ..... 340/572.1
6,111,502 A * 8/2000 Lenglart et al. ..... 340/541
6,327,623 B2 * 12/2001 Watts ..... 709/229
6,369,710 B1 4/2002 Poticny et al.
6,408,395 B1 * 6/2002 Sugahara et al. ..... 713/310
7,460,932 B2 * 12/2008 Johns et al. ..... 700/299
2004/0239503 A1 * 12/2004 Rider et al. ..... 340/572.1
2007/0018813 A1 1/2007 Liggitt

FOREIGN PATENT DOCUMENTS

EP 1482465 A1 12/2004
WO 2005073929 A1 8/2005
WO 2006069042 A2 6/2006

OTHER PUBLICATIONS

International Search Report dated Jan. 18, 2010 for International Application Serial No. PCT/US2009/005166, International Filing Date Sep. 15, 2009 consisting of 16-pages.

* cited by examiner

*Primary Examiner* — Daniel Previl
(74) *Attorney, Agent, or Firm* — Alan M. Weisberg; Christopher & Weisberg, P.A.

(57) ABSTRACT

A system and method for managing the power consumption of power-consuming devices. A remote device manager transmits power save schedules to a local device manager over a communication network such as the internet. The local device manager transmits power save commands to one or more devices in a location such as a store, over a dedicated local communication network. The commands instruct one or more devices to activate or de-activate its power save mode according to the power save schedules. The commands could be dependent upon one or more trigger events.

20 Claims, 4 Drawing Sheets

EAS POWER MANAGEMENT SYSTEM

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to a method and system for power management and more specifically to a method and system for managing and controlling the power levels of devices in an electronic article surveillance security system.

BACKGROUND OF THE INVENTION

Electronic Article Surveillance ("EAS") systems are detection systems that allow the detection of a marker or tag within a given detection region. EAS systems have many uses, but most often they are used as security systems to prevent shoplifting from stores or removal of property from office buildings. EAS systems come in many different forms and make use of a number of different technologies.

A typical EAS system includes an electronic detection EAS unit, markers and/or tags, and a detacher or deactivator. The detection unit includes transmitter and receiver antennas and is used to detect any active markers or tags brought within the range of the detection unit. The antenna portions of the detection units can, for example, be bolted to floors as pedestals, buried under floors, mounted on walls, or hung from ceilings. The detection units are usually placed in high traffic areas, such as entrances and exits of stores or office buildings. The deactivators transmit signals used to detect and/or deactivate the tags.

The markers and/or tags have special characteristics and are specifically designed to be affixed to or embedded in merchandise or other objects sought to be protected. When an active marker passes through the detection unit, the alarm is sounded, a light is activated, and/or some other suitable control devices are set into operation indicating the removal of the marker from the proscribed detection region covered by the detection unit.

Most EAS systems operate using the same general principles. The detection unit includes one or more transmitters and receivers. The transmitter sends a signal at defined frequencies across the detection region. For example, in a retail store, placing the transmitter and receiver on opposite sides of a checkout aisle or an exit usually forms the detection region. When a marker enters the region, it creates a disturbance to the signal being sent by the transmitter. For example, the marker may alter the signal sent by the transmitter by using a simple semiconductor junction, a tuned circuit composed of an inductor and capacitor, soft magnetic strips or wires, or vibrating resonators. The marker may also alter the signal by repeating the signal for a period of time after the transmitter terminates the signal transmission. This disturbance caused by the marker is subsequently detected by the receiver through the receipt of a signal having an expected frequency, the receipt of a signal at an expected time, or both. As an alternative to the basic design described above, the receiver and transmitter units, including their respective antennas, can be mounted in a single housing.

Power management/saving systems are common in the art. Typical power saving and management systems use traditional timers to shut down appliances, tools, and machines when not in use, and power these products back up again when their use is desired. During "down" times, in order to conserve energy, the powered machines are completely shut down. Further, typical power management systems group all powered tools or machines together on one schedule resulting in an impractical energy management system not to mention the inefficiencies of having to power up all machines if only some are to be in use at a given time.

Many power management systems base power conservation on separate timers. Strict interval-based timers have not worked well in power management systems because the timers tend to drift and are affected by actual and unforeseen power outages. This is not practical for EAS systems since this will result in the EAS equipment not being powered up when it should be. Further, most EAS equipment should not be "unplugged" or powered off completely, which is what occurs when they are connected to timers, since this can result in data loss and can make applications such as alarm management and other data-logging processes useless.

Other power management systems provide rigid, inflexible time schedules that schedule each device within a particular store or building. There is no centralized facility that receives power status information from each device in many locations and alters schedules accordingly. For example, while a weekday evening may be normally considered a slow time for retail shoppers, and therefore a feasible time to power down store equipment, other events (back to school rush, holiday, a large event at a mall that might bring people into the store) might alter the power mode schedules of the store devices. Further, feedback from store devices might give indications that certain regions within a retail store are not frequented at certain times and therefore many devices in those regions can enter a power save mode.

In addition, many other power management systems can only be altered by regional store managers, if at all. Other scheduling systems are canned software packages and cannot be altered at all. There is often a need for regional store managers, or local store managers to easily access their store's power mode schedules and alter them according to any of the reasons outlined above.

Therefore, what is needed is a flexible system and method for controlling, monitoring and managing the power usage of individual and/or groups of components in an electronic article surveillance system.

SUMMARY OF THE INVENTION

The present invention advantageously provides a method and system for managing the power consumption of one or more devices in a given region. In one aspect of the invention, a system for managing power consumption of at least one device is provided. The system includes a first device manager for transmitting at least one power save schedule and a second device manager for receiving the at least one power save schedule. The second device manager is also in communication with the one or more devices and is configured to transmit power save commands based on the at least one power save schedule to the one or more devices and to receive power mode status signals from the one or more devices. The at least one power save schedule defines power mode activation and deactivation times for the one or more devices, where the activation and deactivation takes place upon occurrence of a trigger event.

In another aspect, a central device manager for managing power consumption of at least one device is provided. The device manager includes a scheduling module for creating at least one power save schedule, and a schedule communication module for sending the at least one power save schedule to a local device manager. The local device manager transmits power save commands based on the at least one power save schedule to the at least one device and receives power mode status signals from the one or more devices. The schedule communication module receives the power mode status signals from the local device manager and the scheduling module alters the at least one power save schedule based on the received power mode signals.

In another aspect, a method for managing power consumption of at least one device in an electronic article surveillance interrogation area is provided. The method includes creating at least one power save schedule, the at least one power save schedule dictating when each of the at least one device enters into a power save mode, receiving power status information from each of the at least one device, updating the at least one power save schedule based upon the received power status information, and transmitting power mode commands to the at least one device. The power mode commands are based upon the at least one power save schedule and the power status information and instruct the at least one device to either activate or deactivate their power save mode.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
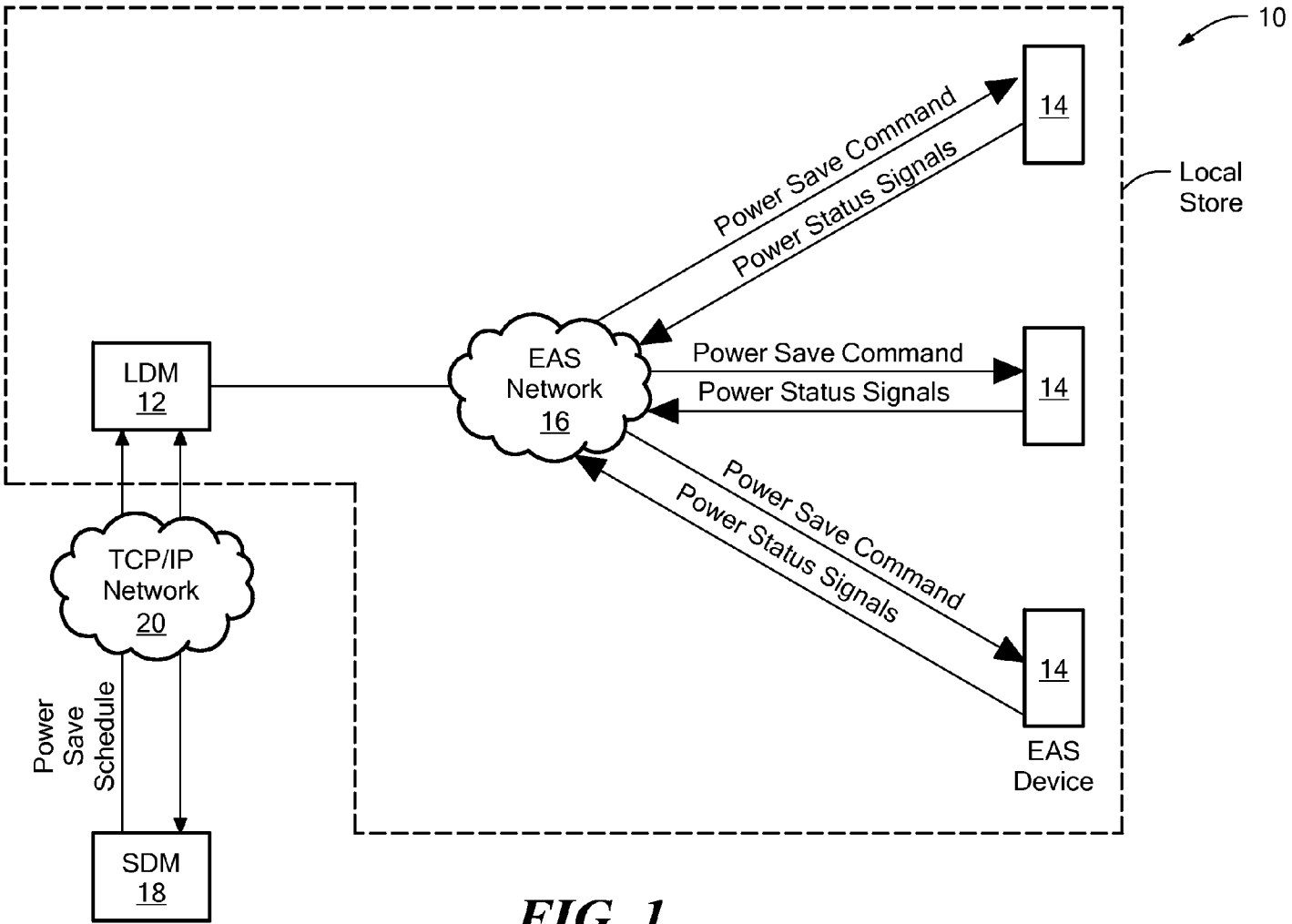
FIG. 1 is a block diagram of an exemplary power management system constructed in accordance with the principles of the present invention.

Before describing in detail exemplary embodiments that are in accordance with the present invention, it is noted that the embodiments reside primarily in combinations of apparatus components and processing steps related to implementing a system and method for managing, monitoring and saving power in an electronic article surveillance interrogation system. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides a method and system for managing the power consumption of components in an electronic article surveillance interrogation system. Although the ensuing discussion focuses on electronic article surveillance ("EAS") interrogation systems, the present invention is not limited to a specific type of system and may be applied to any system that utilizes electronic equipment. Referring now to the drawing figures in which like reference designators refer to like elements there is shown in FIG. 1 an apparatus constructed in accordance with the principles of the present invention and designated generally as "10". System 10 represents a power management system for an EAS interrogation system. Typical EAS systems includes an EAS reader unit used to transmit interrogation signals to one or more tags within a given interrogation region.

System 10 includes a Local Device Manager ("LDM") 12 in electronic communication with EAS components 14 over a communication such as a local EAS communication network 16. LDM 12 is also in electronic communication with a Smart Device Manager ("SDM") 18 over communication network 20. In one embodiment, network 20 is a Transmission Control Protocol/Internet Protocol ("TCP/IP") network, i.e. the Internet. Local Device Manager 12 includes the necessary hardware, software, processors, data storage, memory and user interface modules necessary to communicate with SDM 18 over network 20 and devices 14 over EAS network 16, and store and modify power save schedules for a particular region, i.e. a local retail store having an EAS interrogation system. Similarly, SDM 18 contains data storage and memory modules, along with the hardware and software necessary to create, save, modify, store and transmit to one or more LDMs 12 power save schedules. SDM 18 can communicate with many LDMs 12 over a wide geographic area, thus providing a central location for monitoring and managing the power consumption schedules for a large number of local stores, via its communication with each store's LDM 12.

EAS devices 14 can include any type of equipment used in an EAS interrogation system. For example, an EAS device could be an EAS tag that is affixed to items that are located within an EAS interrogation system interrogation area. In one embodiment, LDM 12, EAS network 16 and EAS devices 14 are all located within one facility, such as for example a retail store. However, LDM 12 need not be physically located within the store or area that it monitors. Regardless of its physical location, LDM 12 provides a localized intelligence in the customer's store and is connected via a dedicated network 16 to all EAS equipment 14 in the store. One purpose of LDM 12 is to collect data from the EAS devices 14 as well as to provide for control and remote service and diagnostics. LDM 12 can thus control the functional state of the EAS equipment 14 based upon internal and external triggers such as, for example, time of day, Point-Of-Sale ("POS") transactions, people counting units/proximity units, etc.

LDM 12 can define and accumulate an EAS operational profile for each EAS device 14 that it is in communication with such that LDM 12 can place each individual EAS device 14, or a group of devices 14 into a low power mode and then "awaken" them when it is appropriate to do so. This approach provides a method for scheduling such that different types of EAS equipment 14 can be given different schedules. For example, EAS detectors can be placed on a different power save schedule than EAS deactivators. These store-level schedule profiles can be defined and stored at the store level or at a corporate level, for example, by an SDM server application. SDM 18 can then be used to manage these profiles across many different stores in many different geographical areas. Advantageously, this allows the user interface to be flexible but provides some control over the system by either the customer or a third party service organization. The profiles can be modified either at an upper level (i.e. by SDM 18) or within the store itself (i.e. via each store's LDM 12).

SDM 18 can include a scheduling module for creating at least one power save schedule. SDM 18 can also include a schedule communication module for communicating with LDM 12 and for sending the power save schedules to LDM 12. The schedule communication module receive power mode status signals from LDM 12, and the scheduling module can then alter the power save schedules based on the received power mode signals.

Thus, as depicted in FIG. 1, LDM 12 connects to the EAS devices 14 via dedicated EAS network 16. The LDM 12 connects to the SDM 18 via a TCP/IP network, such as the Internet. SDM 18 distributes Power Save Schedules to LDM 12 in each store that it is in communication with. LDM 12 then sends Power Save Commands, i.e., a "Power Save On" command, or a "Power Save Off" command to each EAS device 14 as dictated by the Power Save Schedule.

The EAS Power Management system 10 of the present invention can be implemented in LDM 12. System 10 is used to minimize the power utilization of equipment, such as, for example, EAS devices 14 in locations such as in retail stores that implement item interrogation systems. LDM 12 controls the power usage of the EAS equipment 14 that is connected LDM 12 using one or more of a number of different management schemes. In addition, system 10 allows a customer, via access to a web site, to have a level of control over how power management system 10 is implemented in their store or region.

The EAS Power Management system 10 of the present invention may be implemented in several ways. In one embodiment, a time schedule is established that indicates a specific time interval when a particular EAS device 14 will be in a low power mode. This can be an actual time of day (absolute) or an offset (relative) time and can be managed for each individual device 14 and type. A master schedule could be invoked for all EAS devices 14 that includes an exception list for each device or type of device. For example, at the proper time, LDM 12 sends an appropriate message to an EAS device 14 to either "put it to sleep" or to "wake it up". The schedule could be setup and/or modified either via LDM 12, which may be at the same location as EAS devices 14, i.e., a retail store, or via a remotely-located LDM 12 or SDM 18.

In one embodiment, EAS devices 14 can advantageously be grouped into "zones", i.e., by any given criteria thus allowing for the scheduling of groups of EAS devices 14 rather than having to provide power schedules and power mode commands for each device 14. For example, groupings or "zones" could be according to a specific product type or by physical location in the interrogation region and each zone scheduled accordingly. Special scheduling factors such as holiday hours, special sales, and differing time zone can also be taken into account.

In another embodiment, system 10 can implement a power management schedule based on factors other than time. For example, EAS power management system 10 can provide a power save schedule instructing certain EAS devices 14 or zones to "go to sleep" after a fixed period of inactivity and would then instruct the devices to "wake up" when that device needs to be used. LDM 12 can receive signals from the EAS devices 14 which indicate when those devices are in use, and, in one embodiment, create a "user profile" for that device and modify that device's future power save schedule. For example, a deactivation device could provide a signal to LDM 12 when the device is in use at a scanner or at a POS terminal during a product transaction. This signal would initiate a trigger mechanism in LDM 12, prompting LDM 12 to "wake up" the deactivator if it had previously been powered down, taking it out of its low power or "sleep" mode. This interaction between LDM 12 and the deactivator can be recorded and stored either in LDM 12 or at SDM 18.

Another example of a trigger device that is used to initiate a power mode implementation in a device is the use of a sensor that detects when a person approaches. Thus, a device 14 that may normally be in low power mode may be "awakened" when a person approaches the device 14. Similarly, device 14 could be placed in its low power state by the absence of a person in range of the sensor for a predetermined time period of inactivity. Thus, data obtained from a "people-counting" system that is integrated in the EAS system can be used to trigger the activation or deactivation of EAS device 14. Such a system could use an overhead or antenna-mounted sensor that can detect the presence of a person moving in proximity of, for example, the doorway where the detectors are located. This data can be transmitted back to LDM 12 and used to initiate a low power state or to resume normal state for the detector.

In addition to providing commands to devices that would enable them to power up, system 10 could also provide a trigger mechanism to enable EAS devices 14 to "go to sleep". This could be advantageous during hours when the store is closed in order to avoid the triggering of false alarms. During closed hours when noise inside the store has died down, the EAS sensors can be put on low power. In this fashion, if a rack of clothing inadvertently falls, the stores alarm system wouldn't be sounded if the motion sensors were in sleep mode. This may be implemented, for example, by designating a fixed period of time from the last event recorded from a people-counting device. A signal from the people-counting device to LDM 12 would then enable LDM 12 to shift a particular device, i.e. one or more sensors, from an active mode to "low power" or "sleep" mode. LDM 12 could keep track of each device's power usage and "learn" their patterns in order to establish a schedule for each device 14 or each zone. This ultimately results in minimum power usage for a particular EAS interrogation zone assuming that there are no "false wake up triggers".

It should be noted that LDM 12 can initialize a "full power" mode or a lesser power or "sleep" mode. In one embodiment, "sleep mode" is still an operational mode but it is a mode that enables the device to operate on a lower power level.

Figure 2:
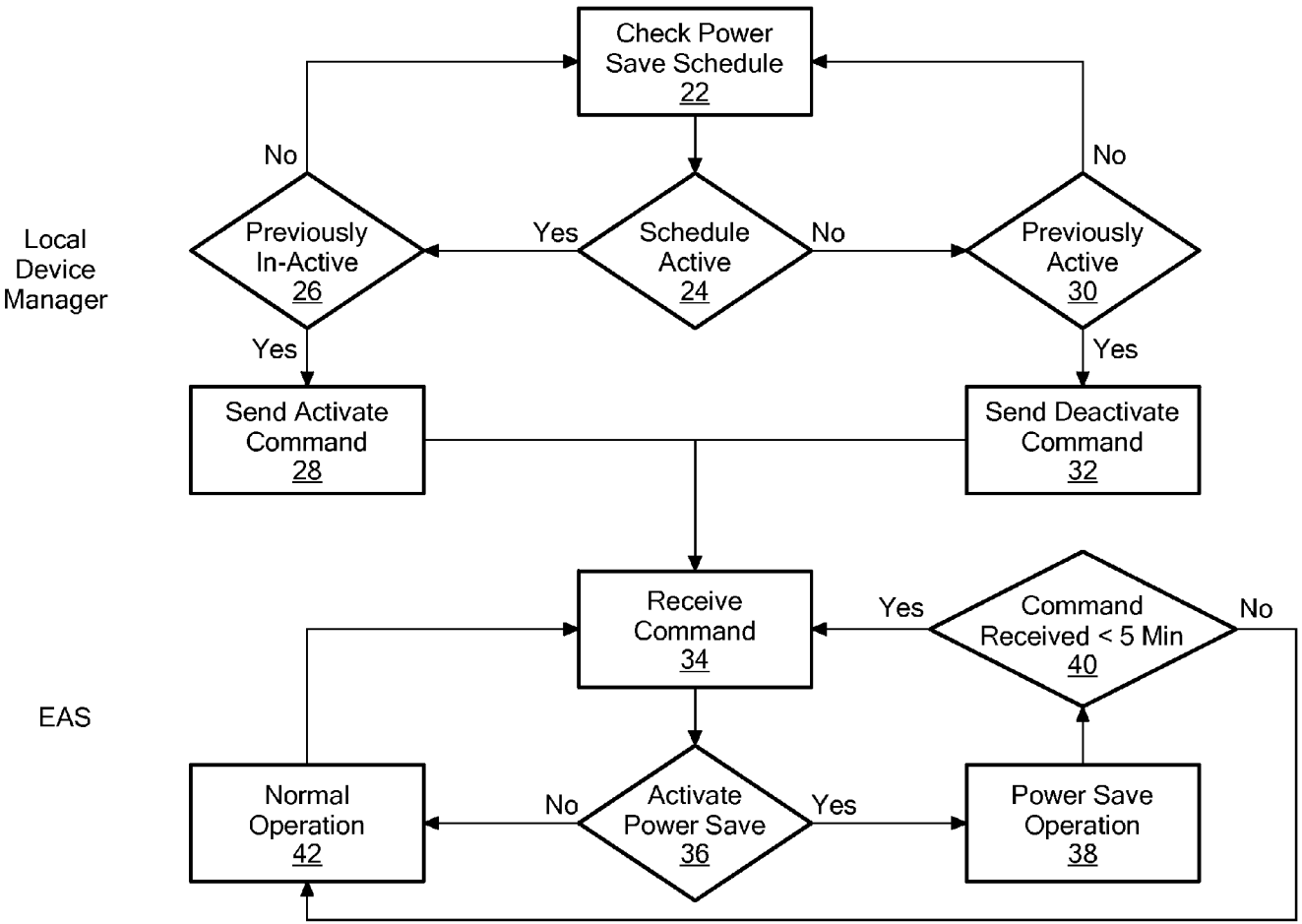
FIG. 2 is a flowchart illustrating the steps performed by the power management system of the present invention.

FIG. 2 is a flowchart illustrating the exemplary steps taken by system 10 of the present invention to transmit power save commands between the LDM 12 and one or more EAS devices 14. Once LDM 12 has received power save schedules from SDM 18 it performs a series of steps that allows it to communicate with each EAS device 14, or groups of devices 14 and assures that each device 14 complies with the schedule. For simplicity, "EAS device" or "target EAS device" is defined herein to mean either one EAS device or a group of EAS devices grouped according to one or more predetermined criteria.

Via step 22, LDM 12 refers to the power save schedule that it received from SDM 18. It then determines, via step 24, if a particular EAS device's power save mode should be active. If the power save mode for the target EAS device 14 should be active (according to the power save schedule received from SDM 18) and it is determined via step 26 that the power save mode for the target EAS device 14 was previously inactive, LDM 12 sends an activate command, via step 28, to the target EAS device. If the power save mode for the target EAS device 14 was already active, there is no need to send a command to the EAS device 14, and LDM 12 checks the power save schedule for the next EAS device 14, via step 22. If it is determined, via step 24, that the power save mode for the target EAS device 14 is not active, but was previously active, as determined by step 30, then LDM 12 sends, via step 32, a deactivate command to the target EAS device 14. If the target EAS device 14 was previously inactive then there is no need to send a deactivation signal and LDM 12 checks the power save schedule for the next EAS device 14.

Referring to FIG. 2 from the perspective of a target EAS device 14, the EAS device 14 receives, via step 34, a command from LDM 12. As discussed above, this command could be a command to active the power save mode of the target EAS device 14 or to de-activate it. Thus, if the command is to activate the power save mode for the target device 14, as determined by step 36, a power save operation is invoked, via step 38.

In one embodiment, system 10 includes a "fail safe" feature, which accounts for unforeseen communication loss between LDM 12 and its target EAS device. In this scenario, EAS device 14 determines, via step 40, if another command is received from the LDM 12 within a predetermined period of time, e.g. five minutes. If a command is received within the preset time limit, then the process proceeds as described above beginning with step 34. If no command is received within the predetermined time period then it is assumed that there was a communication loss between LDM 12 and the EAS device 14. In this embodiment, the target EAS device 14 reverts back to its normal operation, via step 42. "Normal" operation could be its fully powered up operation, i.e., its operation without the implementation of power mode constraints due to the power save schedule. The operation of reverting back to normal (non-power save mode) operation is one embodiment of the present invention. In other embodiments, it is also contemplated that the target EAS device 14 remains in power save mode until another command is received from LDM 12. Via step 36, if the command received is to deactivate the target EAS device 14, then the device returns to normal operation via step 42. i.e., with power save mode deactivated.

The present invention allows EAS devices to be toggled from "normal" mode to a "power save" mode. "Power save mode" means that a particular EAS device, or group of devices, will follow the power constraints and power down as dictated in the power save schedule. The amount of power saved in "power save" mode can vary from device to device. For example, when in power save mode an EAS sensor can deactivate its transmitter, reducing its power by, for example, 75%. Deactivation devices can disable their deactivation and detection transmitter, reducing power their power by, for example, 50%. Thus, the present invention is not limited by the amount of power saved when a device is in power save mode, nor is it limited by what a device does to reduce its power consumption.

Figure 3:
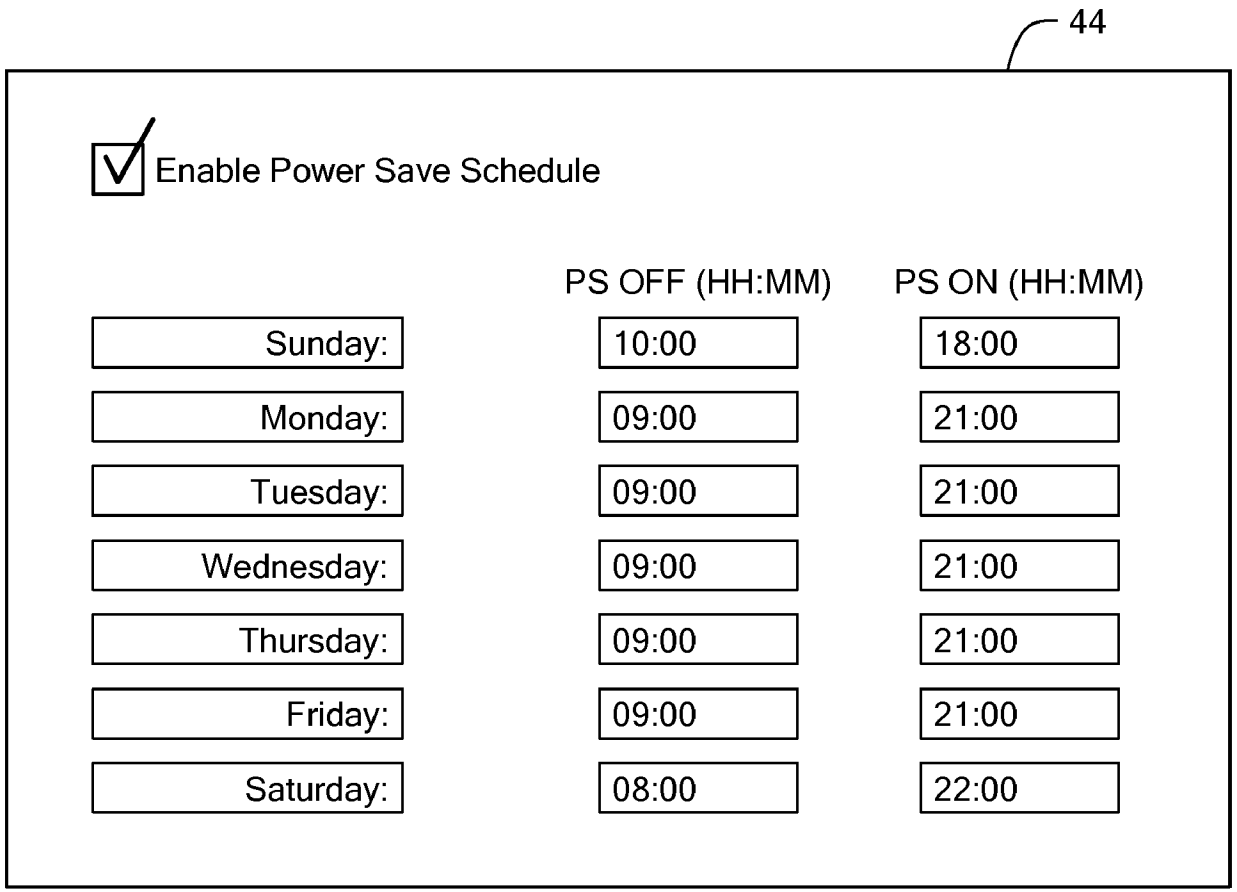
FIG. 3 is an illustration of an exemplary power management schedule in accordance with the principles of the present invention.

FIG. 3 represents an exemplary screen used by an operator at either the LDM 12 location or the SDM 18 location to set and/or revise power save schedules for EAS devices 14 utilizing system 10. In this scenario, which may be used, for example, at a retail store in a shopping mall, a single schedule 44 is used to power up and power down all of the identified EAS devices 14 in a particular EAS interrogation region within the store. In this example, every EAS device 14 is given instructions to power up (Power Save feature is disabled) at 10 AM Sunday morning, and to power back down (Power Save feature is enabled) at 6 PM Sunday evening, to account for a retail store closing early on Sundays. On Monday through Thursday, a schedule for a regular work day requires that each EAS device 14 power up (power save mode disabled) at 9 AM and power down (power save mode enabled) at 9 PM. On Saturday, the power save mode is disabled when the store opens at 8 AM and is enabled when the store closes for the day at 10 PM. The schedule can account for time zones and daylight savings time and can be altered to account for holidays (some are heavy shopping days and others the store may be closed), seasons (back-to-school sales with increased shopping hours), and/or special events (a famous athlete to appear at a mall where the store is located). As discussed above, this schedule is sent by SDM 18 to one or more LDMs 12, where each LDM 12 implements a power save schedule for the EAS devices 14 it controls.

In an alternate embodiment, different schedules can be set for different types of EAS devices. For example, one power save schedule can be created for deactivators and another schedule created for sensors. Or, as discussed above, EAS devices 14 can be grouped together into "zones" depending upon their relative location within the EAS interrogation area. Certain devices 14 may not appear on the schedule and therefore will not receive power save commands from LDM 12.

As discussed above, LDM 12 contains a processor, memory, and data storage capability that enables it to receive power save schedules from SDM 18, to alter and save the power save schedules and to transmit power activation and deactivation commands over EAS network 16 to target EAS devices 14, as shown in FIG. 2. LDM 12 can also receive poll responses from each EAS device 14. These poll responses may include the status of the EAS device's transmitter as well as other "trigger event" information that would enable LDM 12 to implement the power save schedules.

A software application within LDM 12 manages the communications between LDM 12 and the EAS devices 14. The settings for the power save schedule can be kept in a file within LDM 12 along with the other system settings. In one embodiment, the schedule includes seven groups of settings, one for each day of the week. For example, there will be a power save enabled, start time and power save stop time for each day. In one embodiment, Day 0 will be designated as Sunday and Day 6 will be designated as Saturday. Thus, code entries could be as follows:

```
[POWER SAVE]
Day0Enable=1          ; Power save enabled for this day
Day0Start=19:00       ; Power save start time (24 hr)
Day0Stop=09:00        ; Power save stop time (24 hr)
•
•
•
Day6Enable=1
Day6Start=19:00
Day6Stop=10:00
```

Additional settings can be added to the device settings pertaining to enabling/disabling power save mode for that device. Each EAS device 14 can be individually enabled for power save mode. The additional entries for each device is shown below:

| [DEVICE1] | |
|---|---|
| PowerSave=1 | ; Device will follow power save schedule |

Additional entries for the device definition can be as follows:

| [DEVICE_DEF2] | |
|---|---|
| PowerSave=1 | ; Device supports power save |
| PowerSaveOnCmd=01,00,00,70,01,00 | ; Cmd to enable power save |
| PowerSaveOffCmd=01,00,00,70,00, 00 | ; Cmd to disable power save |
| StatusBytes=1 | ; Device supports status bytes |

Upon receipt of a power save activate or de-activate command, each EAS device 14 is instructed to turn its transmitter off and on, respectively. The command itself is a data stream containing data portions that correspond to different features of the data transaction. A typical command sent for each EAS device 14 is as follows:

| Destination Address | Source Address | Data Length | Command 0x70 | Data 0 or 1 | Checksum |
|---|---|---|---|---|---|
| 1 byte | 1 byte | 1 byte | 1 byte | 1 byte | 1 byte |

Here, the data portion of the command contains a "1" to enable power save mode or a 0 to disable power save mode. Each EAS device 14 then responds to the power save command. Its responsive data stream could be as defined below:

| Destination Address | Source Address | Data Length | Command 0x70 | Device ID | Data 0 or 1 | Check-sum |
|---|---|---|---|---|---|---|
| 1 byte | 1 byte | 1 byte | 1 byte | 1 byte | 1 byte | 1 byte |

In another embodiment, the EAS device response to the LDM command includes two bytes to be used for the EAS device status. In one embodiment, the first use of the status bytes indicates the power save state of the EAS device 14. The least significant bit of the status bytes will be set to indicate the current state of the power save mode of the EAS device 14. For example:

Poll Response:

| Destination | Source | | | Device | Data | | |
|---|---|---|---|---|---|---|---|
| Address | Address | Data Length | CMD | Type | Counts | Status | Checksum |
| 1 byte | 1 byte | 1 byte | 1 byte | 1 byte | 1-8 bytes | 2 bytes | 1 byte |

The power save schedules can be compiled and or modified by an operator controlling the LDM 12, SDM 18 or via a third party via the Internet. For example, in one embodiment, configurable power save schedules can be made available to a third party user of system 10 or the owner of the retail store via a secure website that posts the individual power save schedules for the EAS devices. Each schedule can be configurable for each device 14 or group of devices.

Figure 4:
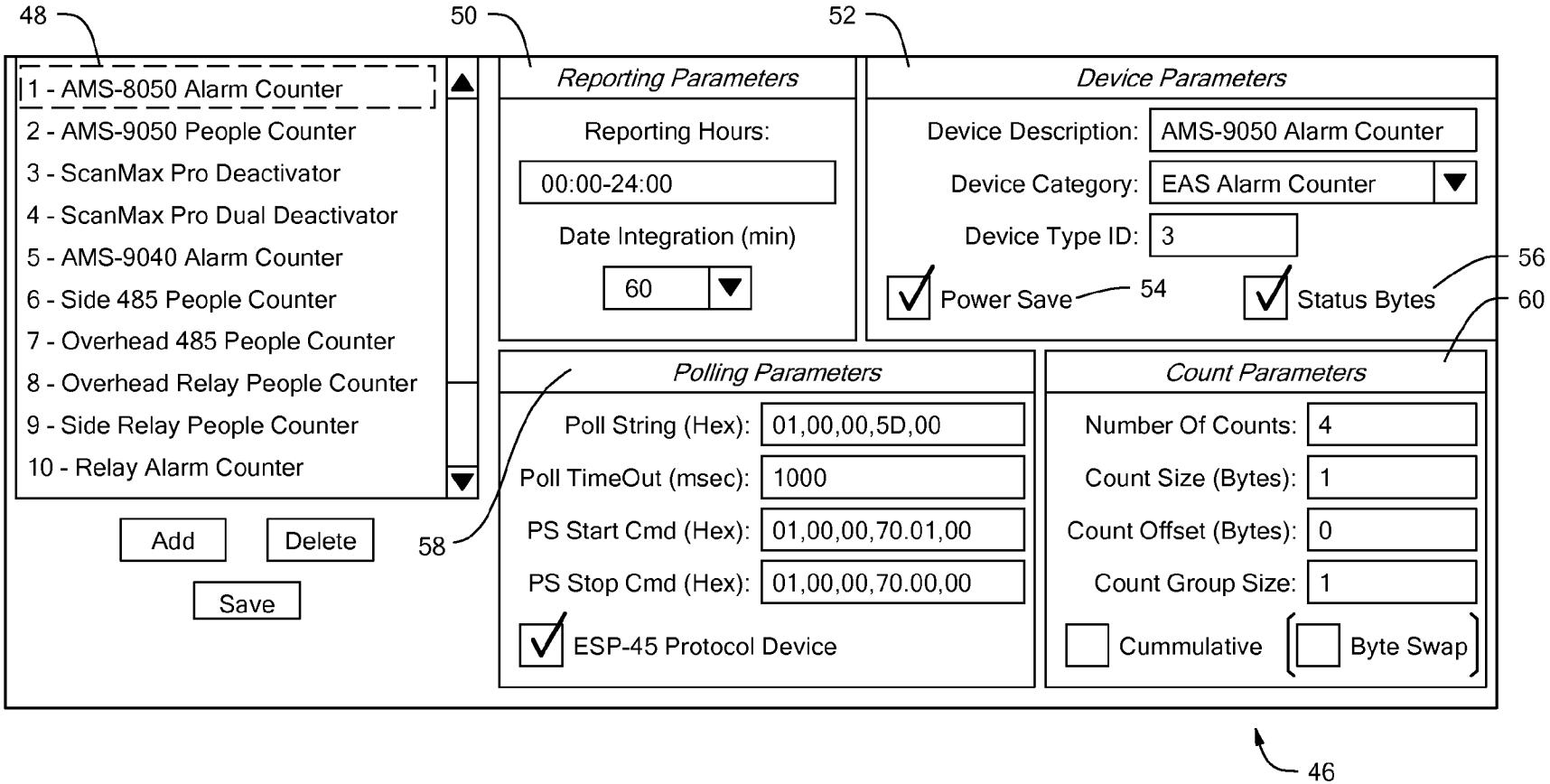
FIG. 4 is an illustration of a device definition screen used by the Local Device Manager in accordance with the principles of the present invention.

FIG. 4 illustrates an exemplary device definition display screen 46 used to configure the primary operation of LDM 12, which includes communication and data collection from the EAS devices 14. The exemplary screen presented in FIG. 4 may be used to define the communication parameters for a specific type of device 14. This screen may be accessed by an operator at LDM 12 or SDM 18 or by a third party via a secure web browser over the Internet. Advantageously, LDM 12 supports the addition of new devices that are to be scheduled by creating a communication protocol definition for each new device 14. This provides a more manageable method than having to modify the executable code every time a new device 14 is created or an existing device is modified.

Device window 48 is used to select or create a name for a specific device type that LDM 12 needs to communicate with. Device names can be added, deleted, or edit via this window. Reporting Parameters window 50 is used to define the reporting time interval (e.g., 24 hour or 1 day) and the Data Integration period which is the next smallest time interval for accumulating data or "counts". The Device Parameters window 52 is used to specify details about the device 14 and define a category and reference type to be used for collecting data. The Power Save checkbox 54 is used to specify whether or not the selected device 14 supports the EAS power save functions as provided by system 10. The Status Bytes checkbox 56 specifies if the selected device 14 will return status bytes to LDM 12 in its poll response.

The Polling Parameters window 58 is used to define the specific message and protocol or format used to communicate to the selected device 14. When the LDM 12 "polls" or sends a request message to device 14, it will use the command and message data specified in this window. Further, the timeout value is defined so that if a response from the intended device is not received, LDM 12 can keep trying. The PS Start and Stop Command fields define the specific messages that are sent to put the device in low power state (Start) or to return it to normal operation (Stop). The checkbox is used to indicate if the device uses a communication protocol that conforms to certain internal documented standards.

The Count Parameters window 60 is used to define the specifics of how the selected device will report counts, if applicable. An EAS system or people-counter device may have multiple antennas and be capable of reporting alarm counts for different zones so these fields define how many, how large, and how the counts are organized (groups). The checkboxes are used to specify if the device accumulates counts or if LDM 12 is required to do this and if each count (if there are multiple bytes) will be sent a high byte or a low byte first.

Utilizing both local intelligence (LDM 12) and global control (SDM 18) to manage the power utilization of EAS equipment, the present invention provides a flexible and configurable tool to allow users the freedom to implement power usage schedules for different EAS devices in an EAS interrogation system in order to realize an aggregate savings in power consumption. System 10 of the present invention uses a combination of time interval, proximity, and transaction demands to trigger EAS devices 14 to low power and normal states. By receiving status information from EAS devices 14, local power usage profiles can be created and monitored and stored either locally within LDM 12 or remotely at SDM 18, or at both locations. System 10 can adapt to different types of EAS equipment and can supply different and unique schedules based not only on EAS device type but also on the device's location in the store. By automatically adjusting schedules for variables such as seasonal store hours, time zones, holidays, and special events, system 10 provides a flexible tool to allow the EAS equipment to be placed in low power mode when not in use but will still allow for data collection, diagnostics, and control.

The present invention provides a power management system that can be applied to virtually any system that utilizes equipment that consumes power. Thus, the present invention is not restricted to only EAS devices in an EAS interrogation system. The system of the present invention is flexible in that it can be customized to control the power levels of all devices in a given region, and information can be collected from various regions, stored and "profiles" created to assist customers develop customized power usage schedules. Each piece of equipment can receive a power save schedule, or groups of equipment can be created and scheduled according to one of several different grouping criteria.

The present invention can be realized in hardware, software, or a combination of hardware and software. Any kind of computing system, or other apparatus adapted for carrying out the methods described herein, is suited to perform the functions described herein.

A typical combination of hardware and software could be a specialized or general purpose computer system having one or more processing elements and a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A system for managing power consumption of at least one device, the system comprising:

a first device manager for transmitting at least one power save schedule; and a second device manager for receiving the at least one power save schedule, the second device manager also in communication with the one or more devices, the second device manager configured to transmit power save commands based on the at least one power save schedule to the one or more devices and to receive power mode status signals from the one or more devices;

the at least one power save schedule defining power mode activation and deactivation times for the one or more devices, activation and deactivation taking place upon occurrence of a trigger event.

2. The system of claim 1, wherein the at least one device is an electronic article surveillance device and is grouped and scheduled according to a location within a corresponding electronic article surveillance interrogation area.

3. The system of claim 1, wherein the at least one device is grouped and scheduled according to a similarity in function with other devices.

4. The system of claim 1, wherein the at least one device is an electronic article surveillance device and the second device manager is located within an electronic article surveillance interrogation area.

5. The system of claim 1, wherein the trigger event is a specific time on a specific day of the week.

6. The system of claim 1, wherein the at least one device is a product deactivation device and the trigger event is a point-of-sale transaction involving the deactivation device.

7. The system of claim 1 wherein the at least one device is a people detection device and the trigger event is based upon a number of people passing within a predetermined proximity of the people detection device.

8. The system of claim 1, wherein the at least one power save schedule can be altered by the first device manager.

9. The system of claim 8, wherein the second device manager transmits the received power mode status signals from each device to the first device manager, and wherein the first device manager alters at least one power save schedule based on the received power mode signals.

10. The system of claim 1, wherein the at least one power save schedule can be altered by the second device manager.

11. The system of claim 1, wherein the second device manager creates a profile for each of the one or more devices and alters the at least one power schedule based on the profile for each device.

12. A power management system for managing power consumption of at least one device, the power management system comprising:

a local device manager in communication with the at least one device; and a remote device manager in communication with the local device manager, the remote device manager comprising:

a scheduling module for creating at least one power save schedule; and a schedule communication module for sending the at least one power save schedule to the local device manager, the local device manager transmitting power save commands based on the at least one power save schedule to the at least one device; and receiving power mode status signals from the one or more devices;

the schedule communication module receiving the power mode status signals from the local device manager, the scheduling module altering the at least one power save schedule based on the received power mode signals.

13. The power management system of claim 12, wherein the local device manager creates a profile for each device and communicates the profile to the remote device manager, the remote device manager storing and managing the profiles received from the local device manager.

14. A method for managing power consumption of at least one device, the method comprising:

creating, at a remote device manager, at least one power save schedule, the at least one power save schedule dictating when each of the at least one device enters into a power save mode;

receiving, at a local device manager, power status information from each of the at least one device, the local device manager in communication with the remote device manager;

updating the at least one power save schedule based upon the received power status information; and transmitting power mode commands to the at least one device, the power mode commands based upon the at least one power save schedule and the power status information and instructing the at least one device to either activate or deactivate their power save mode.

15. The method of claim 14, wherein the power mode commands instruct the at least one device to activate or deactivate their power save mode based upon the occurrence of a trigger event.

16. The method of claim 15, wherein the trigger event is a specific time on a specific day of the week.

17. The method of claim 15, wherein the at least one device is a product deactivation device and the trigger event is a point-of-sale transaction involving the deactivation device.

18. The method of claim 15 wherein the at least one device is a people detection device and the trigger event is based upon a number of people passing within a predetermined proximity of the detection device.

19. The method of claim 15, wherein the at least one device is an electronic article surveillance device and further comprising grouping and scheduling the at least one device according to a location within a corresponding electronic article surveillance interrogation area.

20. The method of claim 15, further comprising grouping and scheduling the at least one device according to a similarity in function with other devices.

* * * * *